US005624036A

United States Patent [19]

Roulin et al.

[11] Patent Number: 5,624,036

[45] Date of Patent: Apr. 29, 1997

[54] BLISTER PACK

[75] Inventors: Monique Roulin, Aesch, Switzerland; Manfred Gerber, Singen, Germany; Heinz Oster, Feuerthalen, Switzerland

[73] Assignee: Alusuisse Technology & Management Ltd., Switzerland

[21] Appl. No.: 552,239

[22] Filed: Nov. 2, 1995

[30] Foreign Application Priority Data

Dec. 8, 1994 [CH] Switzerland ..... 3718/94

[51] Int. Cl.[6] ..... B65D 83/04; B65D 85/58

[52] U.S. Cl. ..... 206/534; 206/232; 206/463; 206/539

[58] Field of Search ..... 206/528, 531, 206/532, 538, 534, 539, 459.5, 461, 463, 232; 383/68, 69

[56] References Cited

U.S. PATENT DOCUMENTS

| | | | |
|---|---|---|---|
| 2,877,893 | 3/1959 | Volckening et al. | 206/232 |
| 3,302,777 | 2/1967 | Sparks | 206/232 |
| 3,381,808 | 5/1968 | McGraw, II | 206/534 |
| 3,737,029 | 6/1973 | Serrell et al. . | |
| 3,933,245 | 1/1976 | Mullen | 206/232 |
| 4,295,567 | 10/1981 | Knudsen | 206/534 |
| 4,340,141 | 7/1982 | Fischer | 206/531 |
| 5,129,527 | 7/1992 | Lataix | 206/461 |
| 5,181,189 | 1/1993 | Hafner | 206/534 |
| 5,413,215 | 5/1995 | Hardinger, Jr. | 206/308.1 |

FOREIGN PATENT DOCUMENTS

WO-A9421530 9/1994 WIPO .

*Primary Examiner*—Bryon P. Gehman
*Assistant Examiner*—Luan K. Bui
*Attorney, Agent, or Firm*—Bachman & LaPointe, P.C.

[57] ABSTRACT

Blister pack without additional outer packaging for pharmaceuticals, having a base with a plurality of recesses that are surrounded by a shoulder and a lid foil attached to the shoulder, where removable contents are accommodated in the recesses and can be removed therefrom by pressing in the recess in question and penetrating the lid foil or by removing the lid foil over the recess, and having an accompanying leaflet. The accompanying leaflet represents part of the blister pack and is situated within the confines of the blister pack, for example in a compartmemt in the base or in a gripping facility on one side of the blister pack.

14 Claims, 3 Drawing Sheets

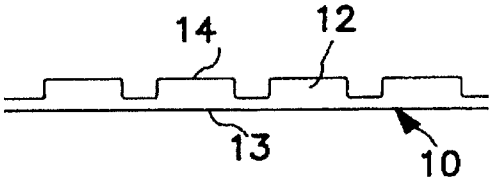
FIG. IC
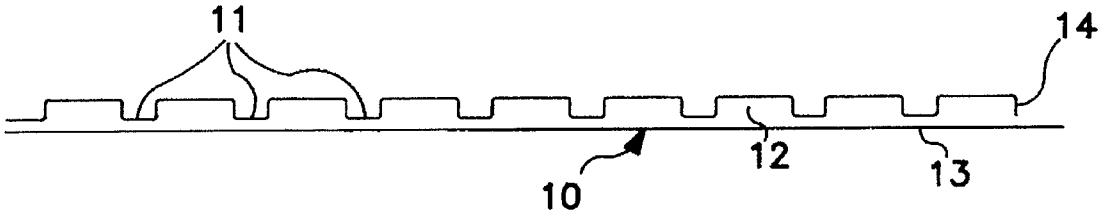
FIG. IB
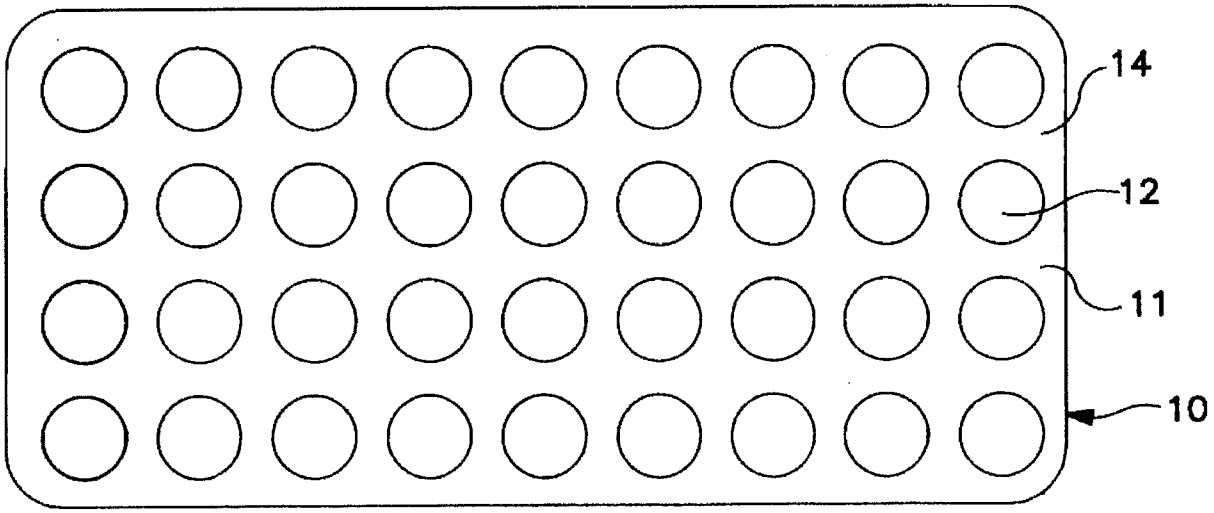
FIG. IA

BLISTER PACK

BACKGROUND

The present invention relates to a blister pack without additional outer packaging for pharmaceuticals, having a base with a plurality of recesses that are surrounded by a shoulder and a lid foil attached to the shoulder, where removable contents are accommodated in the recesses and can be removed therefrom by pressing the recess in question and penetrating the lid foil or by removing the lid foil over the recess, and having an accompanying leaflet.

It is known to fill the bases of blister packs, in particular push-through packs, with contents, to cover the whole of base with a lid material, and to seal the lid material in place. The blister pack is characterized by way of a single or, in particular, by a plurality of single compartments that accommodate e.g. solid items, shaped solid preparations or pharmaceutical products such as tablets or dragées. If a single item e.g. a tablet is to be removed from a blister pack, the recess in the base is pressed and the tablet pushed through the lid material The present invention embraces various kinds of blister packs. This includes e.g. the so-called push-through packs. Push-through packs are e.g. such that the lid material is of aluminum foil or an aluminum foil laminate. Aluminum foil is a preferred material for the lids on blister packs as the thickness of the material employed requires relatively little force for it to rupture. Consequently, the energy for penetration is low and the aluminum exhibits essentially no elasticity. As a rule the base of the blister pack is made of plastic, for example plastics such as PVC, polyamides, polyolefins, polyesters and laminates or multi-layered materials containing at least one of these materials and, if desired, also containing an aluminum foil. Other blister packs feature a base which is covered by a lid foil. The lid foil may cover the whole of the base area and is usefully provided with a line of weakness in the region of each recess, or each recess may be covered with an individual lid segment. Within the line of weakness or on each lid segment may be a tab for gripping which enables the individual recess to be exposed by peeling back the lid segment. As a rule, the base and the lid are of the above mentioned materials, whereby plastic laminates may also be employed for the lid materials.

Such blister packs have found widespread use in the field of health care and for distribution of sweets such as pastilles and bonbons. Because of the possibility they offer to store sensitive contents carefully, and because of the ease with which the contents can be removed from them, such blister packs are now regarded as indispensable in daily life. With increasing endeavors being made to cut costs in health care, attempts are being made to keep the blister packs as small as possible. Further, the amount of packaging material and the product mix in packaging should be kept as small as possible, and the same or similar recyclable materials should be used for packaging purposes. Up to now blister packs have always been contained in outer packaging such as a plastic or cardboard box. The box also contains the accompanying leaflet providing information about the product. The leaflet is thus contained in the packaging, protected from loss. Last, but not least, because of the accompanying leaflet, it is compulsory to provide additional, expensive packaging i.e. the container in the form of a box.

SUMMARY OF THE INVENTION

The object of the present invention is to propose blister packs without additional outer packaging which enable tablets, dragées, capsules, ampoules etc. to be protected from extraneous influences such as moisture and dirt until use, and the accompanying leaflet to be kept with the blister pack, without the aid of additional outer packaging, available for the end user.

That object is achieved by way of the invention in that the accompanying leaflet forms part of the blister pack and is situated within the confines of the blister pack, where the blister pack features a plurality of recesses in the base containing removable contents, and the base features a compartment accommodating the accompanying leaflet, and the compartment features two long sides and two short sides, and the long sides or the long sides and the short sides are delimited by the shoulders, and the compartment is covered by the lid foil, or the blister pack features a gripping facility at its sides and the leaflet is accommodated in the gripping facility.

BRIEF DESCRIPTION OF THE DRAWINGS

The present invention will be more readily understood from a consideration of the accompanying drawings, wherein:

FIG. 1A is a plan view of a normally used blister pack, FIG. 1B is a longitudinal section through the blister pack of FIG. 1A, and FIG. 1C is a cross-section through the blister pack of FIG. 1A;

DETAILED DESCRIPTION OF PREFERRED EMBODIMENTS

Figure 2C:
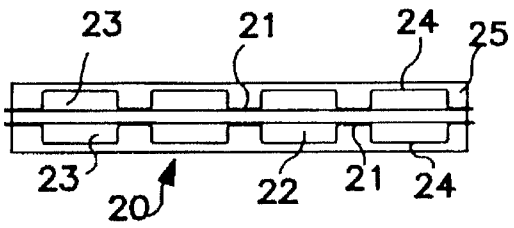
FIG. 2C is a cross-section through the blister pack of FIG. 2A.

The bases of the present blister packs may be embossed, cast, deep drawn or vacuum formed bases out of plastic, plastic laminates, plastic/paper laminates or plastic/metal foil laminates. Suitable plastics for bases are e.g. films and film laminates containing PVC, polyamides, polyolefins, polyesters, polycarbonates etc. The bases may also feature a barrier layer against gases and vapors. Such barrier layers may e.g. be a metal foil such as an aluminum foil embedded in a plastic laminate or, usefully, ceramic layers or metallic layers embedded between two plastic layers. Ceramic layers may be produced e.g. by evaporating metals, oxides or nitrides of aluminum, silicon and other metals and semi-metals in vacuum and depositing the substances on a plastic substrate. These methods are e.g. known as chemical vapour deposition and physical vapor deposition or sputtering. The ceramic layers may by preference contain aluminum oxides or silicon oxides or may be mixtures of various oxides, if desired also mixed with metals such as e.g. silicon or aluminum. Metal layers may be created by evaporating metals in vacuum and depositing the metals on a plastic substrate; aluminum layers may be mentioned here by way of example. The plastic substrate may be a plastic film or a plastic base made of the above mentioned plastics. As a rule, the lid material for the push-through pack is an aluminum foil or a laminate containing aluminium foil. It has also been proposed to replace the aluminum foil with a plastic that exhibits low elasticity and poor stretching properties. Such plastics are obtained e.g. when large amounts of filler materials are added to the plastic. This last mentioned version would make it possible to obtain easily sorted waste material i.e. no mixture of metal and plastics. Plastics and plastic laminates could also be employed for blister packs with peel back lid material. The bases usually feature between 6 and 30 recesses in the form of cups or dishes. The recesses are surrounded by a shoulder, said shoulders together forming an interconnected flat plane. The bases are prepared e.g. as an endless strip with the contents in the recesses and brought together with the lid material, in particular in lid foil form, likewise in the form of an endless strip. The lid foil covers the base completely and e.g. by sealing or adhesive bonding is joined to the base at the shoulders. The lid foil may be sealed or adhesively bonded to the shoulders over the whole area or, by choosing a special sealing tool or bonding pattern for the purpose, this sealing or bonding may be only partial. Next, the endless strip of lidded base part may be cut to the desired size. This may be performed e.g. using a stamping tool. At the same time, the blister pack may be give outer contours, or it is possible to provide weaknesses in the lid material or the base in order to allow the blister pack to be bent or to create lid segments, making easy removal of the lid segment and removal of the contents possible.

A blister pack according to the invention may feature the desired number of recesses for the contents such as tablets, dragées etc. and is provided in the base e.g. with a further recess which is substantially larger than the recesses for the contents. This recess will be termed compartment and the compartment may extend e.g. over the whole length or the whole breadth of a blister pack. In this case the compartment features no ends and forms a tube-shaped compartment in which the leaflet may e.g. be inserted. The compartment may also be surrounded by shoulders on all sides or on only three sides and be covered by the lid foil. In one of the process steps during filling the leaflet may be placed in the compartment and the lid foil laid over the compartment and shoulders and joined to the shoulders. The leaflet may then be removed from the compartment by pushing it through or peeling off the lid foil and exposing the compartment. Provision may also be made for the compartment to have a lid foil that can be at least partially peeled back and such that it may be repeatedly peeled back and laid, adhesively bonded, over the compartment. This way the compartment may be opened, the leaflet removed for reading and returned to the compartment which is then closed over by the lid foil. For that purpose the lid foil and/or the shoulders of the base may be coated with a releasable adhesive. The leaflet may, if desired, be stuck in the compartment by means of an adhesive seam joining it to the blister pack, thus securing against loss.

If the blister pack according to the invention is to be provided with a gripping facility, then this facility may e.g. be in the form of a sleeve in the form of a tube that features a longitudinal slit at some place in its periphery. The lidded base may exhibit a bulge, a fold or the like on one of its sides and the base may be inserted into the sleeve along the bulge or fold, such that the bulge or fold comes to rest in the gripping facility. The sleeve then forms a gripping facility which closes e.g. approximately flush with the side of the base. The leaflet may be stored, rolled up, in the space in the gripping facility.

In another useful version of the present invention the blister pack is made up of blister pack strip folded in halves such that both lid foil halves touch and the base halves lie apart from each other and both open ends of the folded strip are held together by a gripping facility in the form of a clamping element, and the leaflet is situated in the gripping facility.

This version represent an extension of the version described above. A base provided with a lid foil usefully exhibits a line of weakness midway along its length or if desired, midway along its breadth. The base is folded along the line of weakness in such a manner that the lid foils on both halves come to rest against each other. A T-shaped strip-like element may be provided at the free ends of the folded and lidded base e.g. between the two lid foils and attached to both lid foils. This way the free ends are secured against springing open and, whereas one arm of the T-shaped strip-like element comes between the lid foils, the other two arms stand perpendicular to the lid foils and base. If a sleeve with a longitudinal slit is now pushed over the T-shaped strip-like element, a gripping tab or facility is provided that, at the same time, is capable of accommodating the leaflet in the residual space inside it.

Instead of a T-shaped strip-like element the base may also feature at its free ends bulges or folds at the edge opposite the central fold of the base, and such that the base penetrates the longitudinal slit in the sleeve and the bulges or folds come to rest in the sleeve thus preventing the base halves from failing out of the gripping facility.

The gripping facility may e.g. be of an opaque or transparent plastic such as polyvinylchlorides, polyolefins, polycarbonates, polyamides, polystyrols, polyacrylates etc. Versions out of cardboard or paper are likewise possible.

The gripping facility may, analogously, also be in the form of a clamping element which as a result of its own elasticity, a hair spring, spiral spring, plate-like spring etc. presses both base halves together and at the same time accommodates the leaflet within the confines of the blister pack.

The present invention is described in the following in greater detail with the aid of FIGS. 1–3.

FIG. 1 shows a blister pack or push-through pack such as are normally used today for packaging pharmaceutical products such as e.g. tablets or dragées. Shown in FIG. 1*a* is a plan view of a blister pack 10 in which the lid foil 13 is joined at the shoulders 11 to the base 14. Indicated are the recesses 12 which are covered by the lid foil. FIG. 1*b* shows a longitudinal section through the blister pack 10. In the region of the shoulders 11 the lid foil 13 is joined to the base 14 e.g. by sealing or adhesive bonding (sealing/adhesive not shown). FIG. 1*c* shows a cross-section through the blister pack 10 with its recesses 12 formed by base 14, lid foil 13 for the contents which are not shown. Such a blister pack is finally packaged and sold with the leaflet in an outer package such as a cardboard box.

Figure 2B:
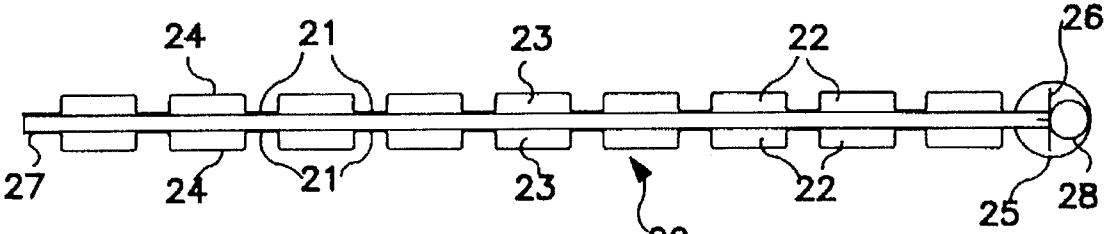
FIG. 2B is a longitudinal section through the blister pack of FIG. 2A.
Figure 2A:
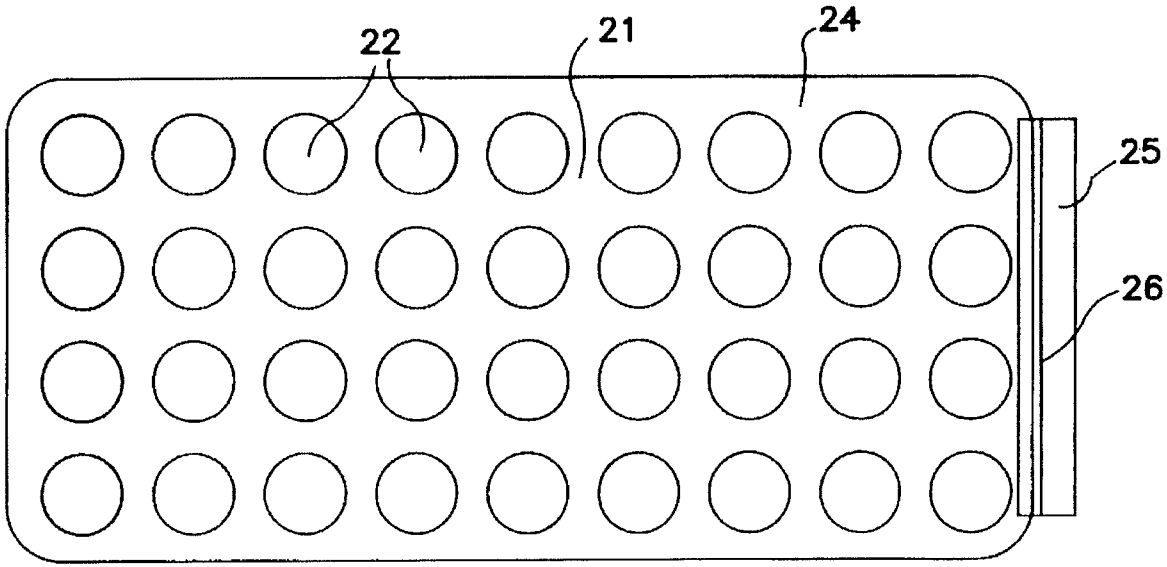
FIG. 2A is a plan view of a blister pack of the present invention.
Figure 3C:
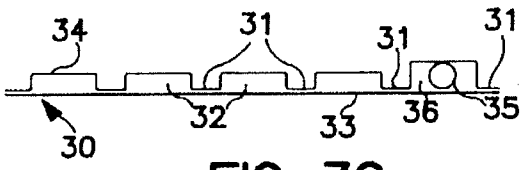
FIG. 3C is a cross-section through the blister pack of FIG. 3A.
Figure 3D:
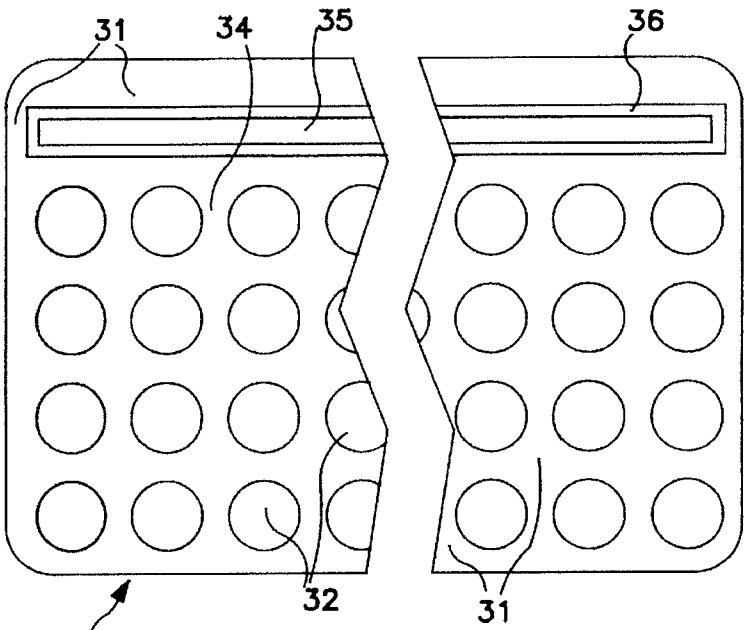
FIG. 3D is a plan view of another embodiment of the blister pack of the present invention.
Figure 3B:
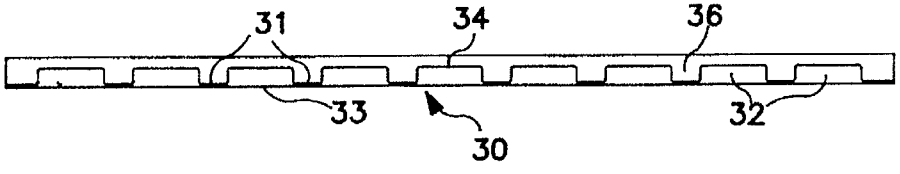
FIG. 3B is a longitudinal section through the blister pack of FIG. 3A.
Figure 3A:
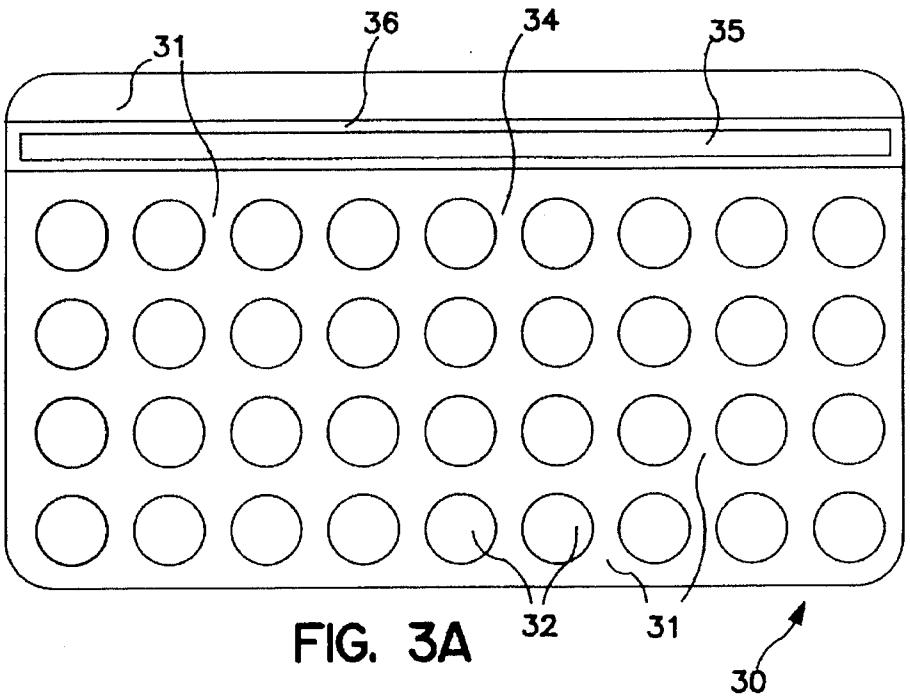
FIG. 3A is a plan view of another embodiment of the blister pack of the present invention.

FIG. 2 shows an expedient version of a blister pack 20 according the invention viz., in a) a plan view, b) a longitudinal section and e) a transverse section through the blister pack 20. The blister pack 20 features a base 24 which is covered via the shoulders by the lid foil 23. A gripping facility 25 is provided at the small side of the pack 20. The gripping facility 25 is secured against failing off by means of a T-shaped strip-like element 26. It can be seen from FIG. 2*b* that a blister pack strip has been folded at the middle, forming a fold 27, in such a way that the lid foil halves 23 come to rest against each other. The base 24 is therefore made up of two halves with the recesses 22 of both halves directly over each other. The lid foil 23 is joined to the base 24 at the shoulders 21. A T-shaped strip-like element 26 is situated at the fold 27 at the opposite end of the blister pack. This T-shaped strip-like element 26 may for example be sealed or adhesively bonded between the two lid foils 23, or be attached by mechanical means such as dips. Both free arms of the T-shaped strip-like element stand approximately perpendicular to the lid foils 23 and the base halves. The strip-like elements may e.g. be an injection molded or cast part made of plastic, or a part made of paper or cardboard. Instead of the T-shaped strip-like element 26 a bulge of material may be provided on each base half, or both edge regions of the blister pack 20 may be folded outwards. A gripping facility 25, for example a sleeve with a longitudinal slit that extends essentially the whole length or breadth of the sleeve and is approximately as broad as the material thickness of the folded blister pack, is pushed over the edge of the blister pack in such a manner that the T-shaped strip-like element comes to rest inside the cross-section of the gripping facility 25. The leaflet 28 is situated inside the gripping facility 25. The gripping facility may be rolled up or folded and inserted. On removing the gripping facility 25 from the blister pack, the blister pack can be opened up and the contents removed from the recesses 22. This may be done e.g. by pressing the contents through the lid foil from the base side, or by peeling a lid segment away from the recess 22. The leaflet 28 can be taken out of the space inside the gripping facility 25. FIG. 2*c* shows a section through the blister pack 20. The contents, which for reasons of clarity are not shown here, are situated in the recesses 22 and the lid foils 23 are joined to the bases at the shoulders 21. The gripping facility 25 has been slipped over one end of the blister pack 20 and holds the folded blister pack together.

FIG. 3 shows another exemplified embodiment of the present invention. Shown in FIGS. 3 *a*), *b*), *c*) and *d*) is the blister pack 30 with bases 34 and lid foils 33 that are joined together at the shoulders 31. The lid foil 33 may be sealed or adhesively bonded fully or in part to the shoulder 31 of the bases 34. This sealing and adhesive bonding is not shown here, just as the contents are not shown. It is, however, easy to imagine that the contents such as a tablet, a dragée and the like is situated in each of the recesses. The bases 34, according to the present embodiment, feature, in addition to the recesses 32 for the contents, a further recess which will be termed here a compartment 36. As seen in FIG. 3*a*, the compartment 36 extends the full length of the blister pack 30 and is joined to the lid foil 33 only at the sidewalls via shoulder 31. A leaflet 35 may be folded or rolled and inserted or laid in the compartment. FIG. 3*b* shows a longitudinal section through the blister pack in FIG. 3*a* and FIG. 3*c* shows a transverse cross-section through the blister pack 30 in 3*a* and 3*b*. In the version according to FIG. 3*d*, the compartment 36 is surrounded by shoulders 31, so that the leaflet 35, as the rest of the contents in the recesses 32, is securely enclosed and may be removed from the compartment 36 only by breaking open the lid foil 33 of by peeling back the lid foil 33. Inserting the leaflet 35 takes place therefore in the same process step as inserting the contents prior to sealing or adhesively bonding the lid foil 33 to the base 34.

For reasons of clarity the contents were not shown in the FIG. 1–3. It is, however, obvious that in each case the contents are situated in the recesses. Contents coming into question may be e.g. tablets, dragées, pills, capsules, ampoules, also bonbons, lozenges, and tablets for chewing etc. and not excluded is that the blister packs according to the invention could also be used as packaging for technical articles such as small and very small items or spare parts for machines and equipment and, instead of a leaflet for tablets, dragées etc. the appropriate product information would be provided.

We claim:

1. Blister pack, having a base with a plurality of recesses therein, a shoulder of the base surrounding the recesses, and a lid foil attached to the shoulder, wherein removable contents are accommodated in the recesses for removal therefrom by pressing the recesses and penetrating the lid foil or by removing the lid foil over the recesses, and an accompanying leaflet, wherein the accompanying leaflet is integral with the blister pack, wherein the blister pack features a compartment accommodating the accompanying leaflet integral with said blister pack, wherein said blister pack includes two long sides and two short sides with at least the long sides being delimited by the shoulders, and wherein said compartment is integral with at least one of said sides, wherein the blister pack is made up of a blister pack strip folded in halves such that the lid foil halves lie against each other and both open ends of the folded blister pack strip are held together by a gripping facility including a clamping element, and the leaflet is situated in the gripping facility.

2. Blister pack according to claim 1, without additional outer packaging for pharmaceuticals.

3. Blister pack according to claim 1, wherein the long sides and the short sides are delimited by the shoulders.

4. Blister pack according to claim 1, wherein said compartment is situated within the confines of the blister pack.

5. Blister pack according to claim 1, wherein the leaflet is removed by peeling back the lid foil.

6. Blister pack according to claim 4, wherein the compartment is covered by the lid foil.

7. Blister pack according to claim 1, wherein said gripping facility is connected to at least one of the sides of the blister pack, with the leaflet situated therein.

8. Blister pack according to claim 7, wherein the gripping facility is integral with a short side of the blister pack.

9. Blister pack according to claim 6, wherein the compartment is situated on a long side of the blister pack.

10. Blister pack according to claim 8, wherein said clamping element holds together both ends of the folded blister pack strip, a sleeve secured over the clamping element to form a space in the sleeve, and the leaflet situated in the space.

11. Blister pack according to claim 1, wherein the compartment is removably connected to said blister pack.

12. Blister pack according to claim 10, wherein said clamping element is a T-shaped strip element.

13. Blister pack according to claim 8, wherein the blister pack strip is folded in halves at one of the short sides and the gripping facility is integral with the other short side.

14. Blister pack according to claim 13, wherein the gripping facility is opaque or transparent.

* * * * *